US007493945B2

(12) United States Patent
Doane et al.

(10) Patent No.: US 7,493,945 B2
(45) Date of Patent: Feb. 24, 2009

(54) EXPANDABLE PACKER WITH MOUNTED EXTERIOR SLIPS AND SEAL

(75) Inventors: James C. Doane, Friendswood, TX (US); Jason M. Harper, Cypress, TX (US); Nicholas S. Conner, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/098,509

(22) Filed: Apr. 7, 2008

(65) Prior Publication Data

US 2008/0196884 A1 Aug. 21, 2008

Related U.S. Application Data

(60) Division of application No. 11/118,570, filed on Apr. 29, 2005, now Pat. No. 7,387,170, which is a continuation-in-part of application No. 10/117,521, filed on Apr. 5, 2002.

(51) Int. Cl.
*E21B 33/129* (2006.01)

(52) U.S. Cl. ..... 166/179; 166/134; 166/206

(58) Field of Classification Search ..... 166/179, 166/134, 206, 207; 277/341, 342
See application file for complete search history.

(56) References Cited

U.S. PATENT DOCUMENTS

| | | | | |
|---|---|---|---|---|
| 3,155,164 | A * | 11/1964 | Keener | 166/63 |
| 3,477,506 | A * | 11/1969 | Malone | 166/207 |
| 6,446,717 | B1 * | 9/2002 | White et al. | 166/187 |
| 6,513,600 | B2 * | 2/2003 | Ross | 166/387 |
| 6,691,789 | B2 * | 2/2004 | Jackson et al. | 166/384 |
| 7,017,669 | B2 * | 3/2006 | Johnston et al. | 166/382 |
| 7,128,145 | B2 * | 10/2006 | Mickey | 166/179 |
| 2002/0014339 | A1 * | 2/2002 | Ross | 166/380 |
| 2002/0166672 | A1 * | 11/2002 | White et al. | 166/387 |
| 2003/0205386 | A1 * | 11/2003 | Johnston et al. | 166/382 |
| 2005/0217869 | A1 * | 10/2005 | Doane et al. | 166/387 |

* cited by examiner

*Primary Examiner*—Hoang Dang
(74) *Attorney, Agent, or Firm*—Shawn Hunter

(57) ABSTRACT

A packer device includes a central packer mandrel and a radially surrounding expansion mandrel. At least one slip mandrel carrying wickers surrounds the expansion mandrel and is secured in place upon the expansion mandrel by an annular retaining ring. The slip mandrel is secured to the retaining ring by screw connectors that pass through the slip mandrel and into retainer segments. The retaining ring is clamped between the slip mandrel and segments. Additionally, the packer device carries a fluid seal that is made up of a thermoplastic material with elastomeric energizing elements.

19 Claims, 2 Drawing Sheets

EXPANDABLE PACKER WITH MOUNTED EXTERIOR SLIPS AND SEAL

This application is a divisional of U.S. patent application Ser. No. 11/118,570, filed Apr. 29, 2005, now U.S. Pat. No. 7,387,170 which was a continuation-in-part of U.S. patent application Ser. No. 10/117,521 filed on Apr. 5, 2002.

BACKGROUND OF THE INVENTION

1. Field of the Invention

The invention relates generally to wellbore packer assemblies and, in particular aspects, to packer devices that are set within a wellbore by radial expansion.

2. Description of the Related Art

Traditional packers are comprised of an elastomeric sealing element and at least one mechanically set slip. Typically, a setting tool is run in with the packer to set it. The setting can be accomplished hydraulically due to relative movement created by the setting tool when subjected to applied pressure. This relative movement causes the slips to ride up on cones and extend into biting engagement with the surrounding tubular. At the same time, the sealing element is compressed into sealing contact with the surrounding tubular. The set can be held by a body lock ring, which would prevent the reversal of the relative movement that caused the packer to be set in the first instance.

As an alternative to applying pressure through the tubing to the setting tool to cause the packer to set, another alternative was to run the packer in on wire line with a known electrically-operated setting tool, such as an "E-4"-style setting tool that is available commercially from Baker Oil Tools of Houston, Tex. In setting the packer device, a signal fires the E-4 causing the requisite relative movement for setting. If the packer device is of a retrievable type, a retrieving tool could later be run into the set packer and release the grip of the lock ring and allow movement of the slips back down their respective cones and a stretching out of the sealing element so that the packer device can be removed from the well.

One problem with conventional packer devices arises from the use of elastomeric sealing elements in packer devices. Nitrile rubber and other elastomers tend to extrude from the packer device over time, particularly in high temperatures, thereby compromising their ability to maintain a fluid seal. Additionally, elastomers may react chemically with other chemicals present in the wellbore, thereby degrading their effectiveness. Certain thermoplastic polymers, such as TEFLON® and PEEK, are chemically inert and resistant to high temperatures, which would make them appear to be good candidates for use in creating fluid seals within a wellbore. However, these compounds are also substantially nonpliable, making it difficult to cause them to remain in an outwardly set position against the wall of a surrounding tubular.

A further problem with conventional packer designs is that the presence of ramps on the outer surface of a packer mandrel for setting the slips necessitates a reduction in the available interior bore diameter. As a result, some packer designs seek to create an engagement of packer element slips or wickers by direct radial expansion of the slips or wickers. Examples of such expandable packer designs are found in a parent application to this one, U.S. Patent Publication No. US 2005/0028989 A1. This Publication describes packer devices that are set by radially expanding an outer expansion mandrel in response to fluid pressure from the flowbore.

The inventors have recognized that there are difficulties inherent in mounting a separate slip component to the outside of the expansion mandrel. Merely placing the slip component to radially surround the expansion mandrel can lead to the slip component undesirably shifting with respect to the expansion mandrel during running-in. As a result, the slip component may not be properly seated upon the expansion mandrel during setting, and the wickers of the slips could become poorly anchored. Further, any abrupt change in the geometry of the outer surface of the expansion mandrel, such as sharp grooves or holes, creates a risk that the expansion mandrel could burst or otherwise fail during expansion. Thus, securing an outer slip component directly to the expansion mandrel using, for instance, screws that penetrate the expansion mandrel, would not be desirable.

The present invention addresses the problems of the prior art.

SUMMARY OF THE INVENTION

The invention provides an improved packer device and methods of setting such a device within a wellbore. The exemplary packer device of the present invention is suitable for use in high temperature conditions, since there are essentially no elastomeric sealing components that would tend to fail in response to high temperatures. Additionally, the packer device will remain reliably set even in the presence of high annulus pressures that would tend to urge the packer device back to an unset condition.

In a preferred embodiment, the exemplary packer device includes a central packer mandrel and a radially surrounding expansion mandrel. The expansion mandrel carries an external slip mandrel having a suitable engagement profile for engaging the surrounding casing or other tubular member. The engagement profile of the slip mandrel presents hardened engagement teeth, or wickers. The slip mandrel is preferably axially slotted to allow for expansion. The slip mandrel is mounted upon the expansion mandrel using several mechanisms for ensuring that the slip mandrel remains properly secured to the expansion mandrel during run-in and setting. These mechanisms do not require the expansion mandrel to be penetrated by connectors, such as screws, or provided with abrupt changes in geometry that might risk failure of the expansion mandrel. First, the interface between the slip mandrel and the expansion mandrel is a pair of interlocking corrugated surfaces. Secondly, retaining screws interconnect arcuate portions of the slip mandrel to a retainer ring and a plurality of arcuate slip segments. The packer device may be set using any of a number of known methods for radially expanding the expansion mandrel so that the engagement profiles of the slips are brought into engagement with the surrounding tubular.

In another aspect of the invention, the slip mandrel preferably carries a fluid sealing element that is generally formed of a thermoplastic that is preferably chemically inert and resistant to high temperatures, such as TEFLON® or PEEK. A plurality of energizing elements are disposed within the fluid sealing element to assist in setting of the fluid sealing element.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
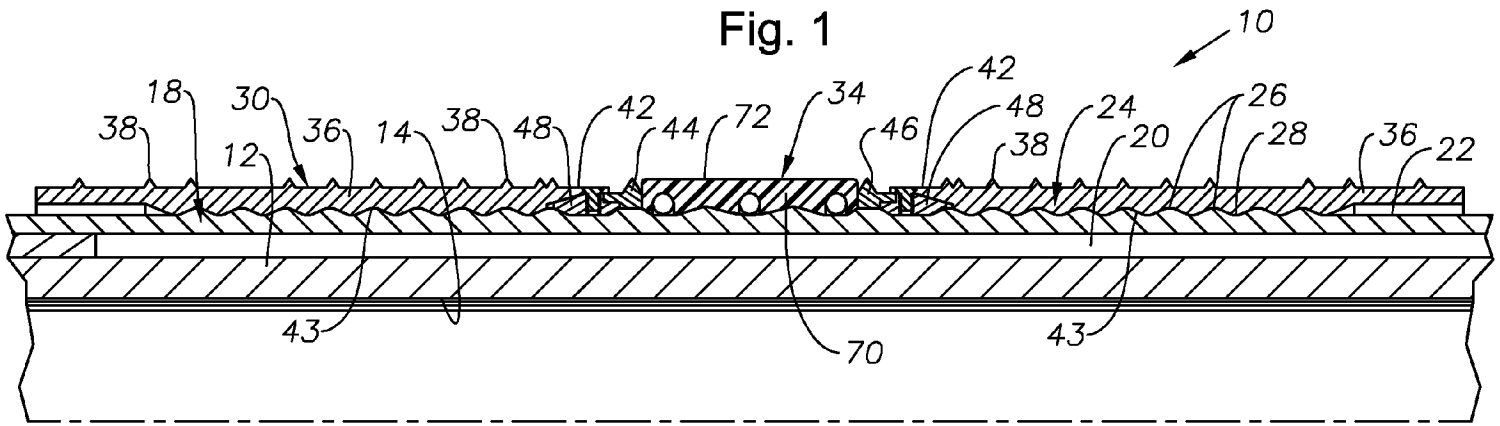
FIG. 1 is a side, one-quarter cross-sectional view of an exemplary packer assembly constructed in accordance with the present invention.
Figure 3:
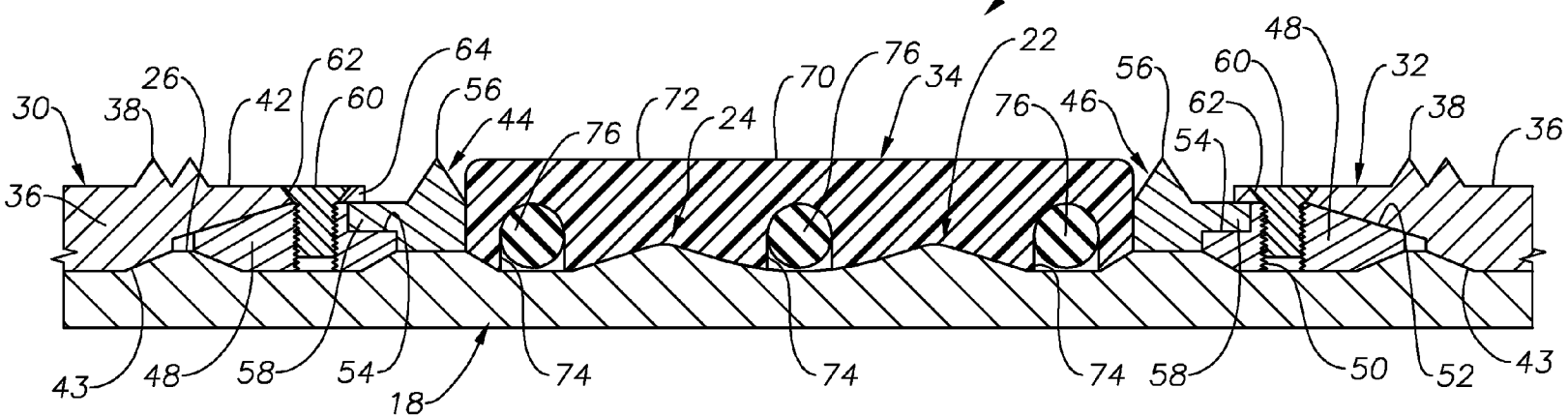
FIG. 3 is an enlarged side, one-quarter cross-sectional view of the fluid seal of the packer assembly and surrounding components.
Figure 2:
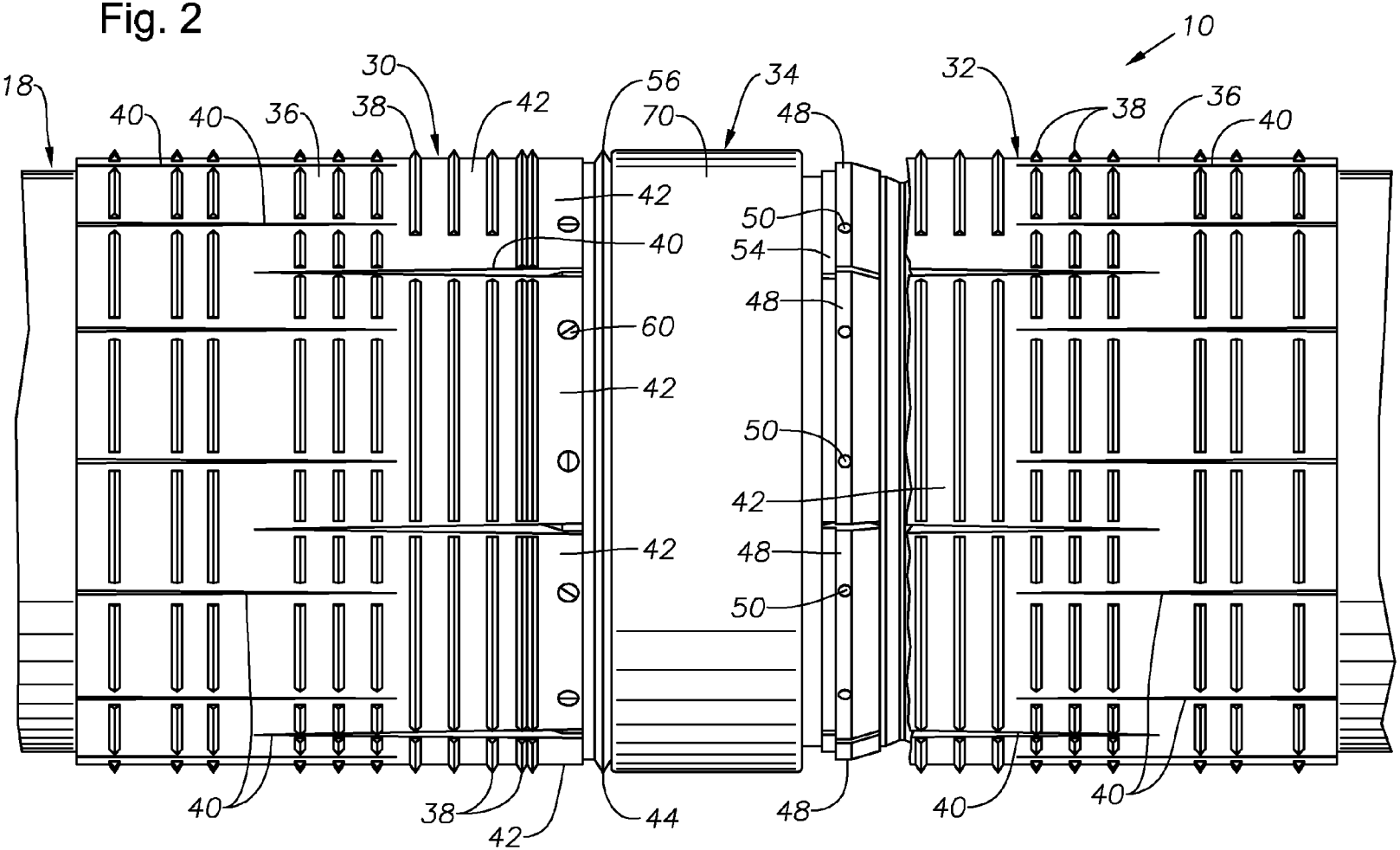
FIG. 2 is an external side view of the packer assembly shown in FIG. 1, now in a radially expanded set position.

FIGS. 1-3 depict an exemplary packer assembly 10. As best shown in FIG. 1, the packer assembly 10 has a generally tubular central packer mandrel 12 that defines an axial flowbore 14 along its length. The central axis of the packer mandrel 12 and the packer assembly 10 is shown at 16. The central packer mandrel 12 is preferably formed of a very hard, non-malleable material, such as 4140 steel. Although not depicted in FIG. 1, it will be understood by those of skill in the art that opposite axial ends of the packer mandrel 12 are typically threaded to allow the packer assembly 10 to be incorporated into a string of tubing members and, thereafter, to be disposed within a wellbore for setting.

An expansion mandrel 18 radially surrounds the packer mandrel 12. The expansion mandrel 18 may be formed of 4140 steel also, but is typically of a lesser thickness than the central mandrel 12 so that it can be expanded radially outwardly. A hydraulic pressure chamber 20 is defined between the expansion mandrel 18 and the packer mandrel 12. The outer radial surface 22 of the expansion mandrel 18 presents a corrugated portion 24 wherein a series of gentle annular ridges 26 are separated by troughs 28.

Slip mandrels 30, 32 radially surround the expansion mandrel 18. The slip mandrels 30, 32 are located on either axial side of a fluid seal element 34, which also surrounds the expansion mandrel 18. Each of the slip mandrels 30, 32 includes a slip mandrel body 36 that presents a series of radially outwardly protruding wickers 38. Each slip mandrel body 36 is, as shown by FIG. 2, partially separated angularly by axial slots 40, 41 to allow the slip mandrels 30, 32 to expand radially. This separation results in the ends of the slip mandrels 30, 32 which face the sealing element 34 to be divided into arcuate slip sections 42. The wickers 38 are shaped and sized so as to provide a substantial biting engagement with a surrounding tubular when the expansion mandrel 18 is radially expanded. Preferably, the wickers 38 are hardened by carburizing or by other methods known in the art. The radially inner surface 43 of each slip mandrel 30, 32 is corrugated in a similar manner as the corrugated portion 24 of the expansion mandrel 18 so that the slip mandrels 30, 32 will seat upon the expansion mandrel 18 in a complimentary manner.

Also surrounding the expansion mandrel 18 are annular retaining rings 44, 46, which are preferably located adjacent the fluid sealing element 34. Additionally, there are a plurality of retainer segments 48 that underlie the retaining rings 44, 46. It is noted that in FIG. 2, one retaining ring 44 is shown installed while the other retaining ring 46 has been removed to provide a better view of the retainer segments 48. Each of the retainer segments 48 is generally rectangular in shape and has a width that approximates the width of the slip sections 42. Additionally, each retainer segment is arcuately curved along its width so that it will lie easily upon the outer surface 22 of the expansion mandrel 18. One or more screw holes 50 is disposed through each of the retainer segments 48. The retainer segments 48 each lie within a trough 28 on the outer radial surface 22 of the expansion mandrel 18. As best seen in FIG. 2, the upper side of each retainer segment 48 presents a sloped surface 52 and an axially protruding ledge 54. The retaining rings 44, 46 each present a sharpened outer edge 56 and a laterally-protruding leg 58.

The slip mandrels 30, 32 are secured in place upon the outer surface 22 of the expansion mandrel 18 by affixing securing screws 60 through screw holes 62 in the slip mandrel sections 42 and into the screw holes 50 of the retainer segments 48. The leg 58 of the retaining rings 44, 46 overlie the ledges 54 of the retainer segments 48. A forward edge portion 64 of the slip sections 42 overlies the leg 58 of the retaining rings 44, 46. Thus, when the screws 60 are tightened into place, the forward edge portion 64 tightens down to some degree upon the leg 58 and the ledges 54. The legs 58 of the retaining rings 44, 46 will keep the retainer segments 48 within the trough 28 by preventing them from moving radially outwardly or axially upon the surface 22 of the expansion mandrel 18. As a result, the slip sections 42 and retainer segments 48 are fixedly secured to the expansion mandrel 18. The retaining rings 44, 46 thus serve the function of helping to hold the slip mandrels 30, 32 in place upon the expansion mandrel 18. This securement, together with the use of the complimentary corrugated surfaces, prevents the slip mandrels 30, 32 from moving axially with respect to the expansion mandrel 18 during running in and during the process of setting the packer assembly 10. It is noted that this securement technique does not require the expansion mandrel 18 to be penetrated by a connector, such as a screw, or to have abrupt changes in the geometry of the expansion mandrel 18, either of which might cause the expansion mandrel 18 to fail during setting. In testing, this securement technique has proven to be quite effective in preventing the slip mandrels 30, 32 from becoming unseated during operation.

The fluid sealing element 34 is specially formed to provide a seal that can be energized into sealing engagement with a surrounding wellbore tubular and, at the same time, is resistant to chemicals within the wellbore and extreme temperatures. The fluid sealing element 34, which is best seen in FIG. 3, includes a seal body 70 with a radially outer sealing surface 72. The seal body 70 is preferably fashioned from a thermoplastic material and preferably a chemically inert thermoplastic material that is resistant to degrading in extreme temperatures. Suitable thermoplastic materials for use in forming the seal body 70 are TEFLON® and PEEK. The radially inner side of the seal body 70 contains three separate annular channels 74. Although three channels are shown, there may be more or fewer than three channels 74. Each of the channels 74 houses an elastomeric ring element 76. The presence of the elastomeric ring elements 76 allows the sealing element 34 to be energized into sealing engagement with a surrounding tubular.

In operation to set the packer device 10, fluid pressure is increased within the hydraulic pressure chamber 20 of the packer assembly 10. Typically, this is done by increasing fluid pressure from the surface of the well inside the production tubing string within which the packer device 10 is incorporated. If desired for setting, a ball or plug (not shown) may be dropped into the tubing string to land on a ball seat (not shown) below the packer device 10 within the tubing string. Pressure is then built up behind the ball or plug. Increased pressure within the flowbore 14 of the packer assembly 10 is transmitted into the hydraulic pressure chamber 20 to expand the expansion mandrel 18 radially outwardly and cause the wickers 38 of the slip mandrel 30 to be set into a surrounding tubular. The sharpened edges 56 of the retaining rings 44, 46 are also set into the surrounding tubular in a biting engagement. The terms "outer tubular" and "surrounding tubular" are used herein to designate generally any surrounding cylindrical surface into which the packer device 10 might be set. Ordinarily, the packer device 10 would be set within a string of steel casing lining the interior of a wellbore. However, a suitably sized packer device 10 could also be set within an inner production tubing string or liner. Alternatively, the "surrounding tubular" might be the uncased surface of a section of open hole within a wellbore.

It is noted that the setting technique described generally above is merely one example of a technique for radially expanding the expansion mandrel 18 into a set position. In fact, any of a number of known methods could be used to cause the expansion mandrel 18 to be radially expanded. For example, a striker module, power charge, or force intensifier, devices of known construction and operation, which are run into the flowbore 16 of the packer device 10 might be used. Numerous setting techniques are described in U.S. Patent Publication No. US 2005/0028989, which is owned by the assignee of the present invention and is herein incorporated by reference.

Those of skill in the art will recognize that numerous modifications and changes may be made to the exemplary designs and embodiments described herein and that the invention is limited only by the claims that follow and any equivalents thereof.

What is claimed is:

1. A packer device comprising:

an expansion mandrel that is radially expandable between unset and set positions;

a slip mandrel radially surrounding the expansion mandrel and having a set of wickers for forming a biting engagement with a surrounding tubular within the wellbore when the expansion mandrel is in its set position; and a fluid seal element radially surrounding the expansion mandrel and comprising:

a) a seal body that is substantially formed of a thermoplastic material; and b) an elastomeric energizing element.

2. The packer device of claim 1 wherein the thermoplastic comprises a TEFLON® polymer.

3. The packer device of claim 1 wherein the elastomeric energizing element is seated within an annular channel formed in the seal body.

4. The packer device of claim 1 further comprising an annular retaining ring that surrounds the expansion mandrel and is secured to the slip mandrel.

5. The packer device of claim 3 further comprising a retainer segment and wherein:

the slip mandrel is affixed to the retainer segment by a connector; and the retaining ring maintains the retainer segment in position upon the expansion mandrel.

6. The packer device of claim 5 wherein the connector comprises a screw.

7. The packer device of claim 5 wherein:

the slip mandrel has a plurality of axial slots that partially divide the slip mandrel into a plurality of slip sections; and a retainer segment underlies a portion of each slip section.

8. The packer device of claim 3 wherein there is a plurality of elastomeric energizing elements retained within a plurality of annular channels.

9. A packer device comprising:

an expansion mandrel that is radially expandable between unset and set positions;

a slip mandrel radially surrounding the expansion mandrel and having a set of wickers for forming a biting engagement with a surrounding tubular within the wellbore when the expansion mandrel is in its set position; and a fluid seal element radially surrounding the expansion mandrel and comprising:

a) a seal body that is substantially formed of a thermoplastic material and having an annular channel formed therein; and b) an elastomeric energizing element disposed within the annular channel.

10. The packer device of claim 9 wherein the thermoplastic comprises a TEFLON® polymer.

11. The packer device of claim 9 further comprising a retainer segment and wherein:

the slip mandrel is affixed to the retainer segment by a connector; and the retaining ring maintains the retainer segment in position upon the expansion mandrel.

12. The packer device of claim 11 wherein the connector comprises a screw.

13. The packer device of claim 9 wherein:

the slip mandrel has a plurality of axial slots that partially divide the slip mandrel into a plurality of slip sections; and a retainer segment underlies a portion of each slip section.

14. The packer device of claim 9 wherein there is a plurality of elastomeric energizing elements retained within a plurality of annular channels.

15. A packer device comprising:

an expansion mandrel that is radially expandable between unset and set positions;

a slip mandrel radially surrounding the expansion mandrel and having a set of wickers for forming a biting engagement with a surrounding tubular within the wellbore when the expansion mandrel is in its set position; and a fluid seal element radially surrounding the expansion mandrel and comprising:

a) a seal body that is substantially formed of a thermoplastic material and having a plurality of annular channels formed therein; and b) an elastomeric energizing element disposed within each of the annular channels.

16. The packer device of claim 15 wherein the thermoplastic comprises a TEFLON® polymer.

17. The packer device of claim 15 further comprising a retainer segment and wherein:

the slip mandrel is affixed to the retainer segment by a connector; and the retaining ring maintains the retainer segment in position upon the expansion mandrel.

18. The packer device of claim 17 wherein the connector comprises a screw.

19. The packer device of claim 15 wherein:

the slip mandrel has a plurality of axial slots that partially divide the slip mandrel into a plurality of slip sections, and a retainer segment underlies a portion of each slip section.

* * * * *